US005642621A

United States Patent [19]

Alary et al.

[11] Patent Number: 5,642,621

[45] Date of Patent: Jul. 1, 1997

[54] DUAL HEAD COMBUSTION CHAMBER

[75] Inventors: Jean-Paul Daniel Alary, St Maur Des Fosses; Denis Roger Henri Ansart, Bois le Roi; Yves Francois André Salan, Savigny S/Orge; Denis Jean Maurice Sandelis, Nangis, all of France

[73] Assignee: Socoiete Nationale D'Etude et de Construction de Moteurs D'Aviation S.N.E.C.M.A., Paris Cedex, France

[21] Appl. No.: 561,275

[22] Filed: Nov. 21, 1995

[30] Foreign Application Priority Data

Nov. 23, 1994 [FR] France ..... 94 14014

[51] Int. Cl.[6] ..... F02C 7/22

[52] U.S. Cl. ..... 60/747

[58] Field of Search ..... 60/747, 746, 740

[56] References Cited

U.S. PATENT DOCUMENTS

| | | | |
|---|---|---|---|
| 4,012,904 | 3/1977 | Nogle . | |
| 4,246,758 | 1/1981 | Caruel et al. | 60/747 |
| 4,292,801 | 10/1981 | Wilkes et al. . | |
| 5,284,019 | 2/1994 | Vdoviak | 60/747 |
| 5,323,604 | 6/1994 | Ekstedt et al. . | |
| 5,351,475 | 10/1994 | Ansart et al. | 60/746 |

FOREIGN PATENT DOCUMENTS

| | | |
|---|---|---|
| 2003554 | 3/1979 | United Kingdom . |
| 2010408 | 6/1979 | United Kingdom . |
| 2030653 | 4/1980 | United Kingdom . |
| 2269449 | 2/1994 | United Kingdom . |

*Primary Examiner*—Charles G. Freay
*Attorney, Agent, or Firm*—Bacon & Thomas

[57] ABSTRACT

An improved dual-head combustion chamber is disclosed having a generally annular configuration extending about a central axis with a low power head, operating during low power engine conditions and a radially displaced high power head operative under high power engine operating conditions. The low power head has N number of fuel/air injector assemblies arranged in an annular array and spaced apart in a circumferential direction about the central axis. The fuel/air injector assemblies of the low power head have an air permeability of P1. The high power head also is arranged in a generally annular array with N number of first fuel/air injector assemblies and N number of second fuel/air injector assemblies with each of the second fuel/air injector assemblies aligned with a fuel/air injector assembly of the low power head along a radius line extending from the central axis. The second fuel/air injector assemblies have an air permeability of P2 such that P2 is greater than P1 and supply a fuel/air mixture to the combustion chamber during high power operation. The first fuel/air injector assemblies located in the high power head are located circumferentially spaced between adjacent second fuel/air injector assemblies. The first fuel/air injector assemblies have an air permeability of P1 and supply fuel/air mixture to the combustion chamber during low power operation.

7 Claims, 6 Drawing Sheets

DUAL HEAD COMBUSTION CHAMBER

BACKGROUND OF THE INVENTION

The present invention relates to a dual head combustion chamber for a gas turbine engine, more particularly such a dual head combustion chamber having improved radial distribution of the outlet temperatures and improved operation during the low power mode.

Dual-head combustion chambers for aircraft turbojet engines are known in which a low power head operates during low power engine operation, such as during landing, and a high power head which operates during high power engine operation, such as during aircraft takeoff. Such known dual head combustion chambers enable turbojet engines to produce, low emissions. In such known combustion chambers, the low power and high power heads generally comprise annular arrays of fuel injectors and are radially spaced from each other about a central axis. Either the low power head or the high power head may be located radially inwardly of the other head.

Although such combustion chambers have been generally successful, drawbacks have been documented. In particular, when the engine is operating in the low power mode, with the low power head operating alone, the exhaust gas temperatures at the combustion outer vary in a radial direction from the central axis of the combustion chamber. Such radial temperature non-homogeneity causes inefficiency in the gas turbine located immediately downstream of the combustion chamber and degrades the heat resistance of the guide vanes and turbine blades.

SUMMARY OF THE INVENTION

An improved dual-head combustion chamber is disclosed having a generally annular configuration extending about a central axis with a low power head, operating during low power engine conditions and a radially displaced high power head operative under high power engine operating conditions. The low power head has N number of fuel/air injector assemblies arranged in an annular array and spaced apart in a circumferential direction about the central axis. The fuel/air injector assemblies of the low power head have an air permeability of P1. The high power head also is arranged in a generally annular array with N number of first fuel/air injector assemblies and N number of second fuel/air injector assemblies with each of the second fuel/air injector assemblies aligned with a fuel/air injector assembly of the low power head along a radius line extending from the central axis. The second fuel/air injector assemblies have an air permeability of P2 such that P2 is greater than P1 and supply a fuel/air mixture to the combustion chamber during high power operation. The first fuel/air injector assemblies located in the high power head are located circumferentially spaced between adjacent second fuel/air injector assemblies. The first fuel/air injector assemblies have an air permeability of P1 and supply fuel/air mixture to the combustion chamber during low power operation.

The dual-head annular combustion chamber of the present invention optimizes the radial distribution of the combustion chamber outlet temperatures and improves the operation of the chamber when the engine is operating in the low power mode. This configuration also allows the use of a conventional ignition system regardless of the radial positioning of the low power head with respect to the high power head. The conventional ignition system may be utilized even if the low power head is located radially inwardly of the high power head.

The high power head issues a fuel/air mixture into the combustion chamber which is ignited by flame propagation from the combustion of the fuel/air mixture from the low power head beginning at a point approximately 70% of the rated speed of the high pressure compressor at full power and operates up to full power of the engine.

Advantageously, the permeability P1 ranges from 10%–12% of the total air flow (W36) entering the combustion chamber, while the permeability P2 ranges from 26%–35% of the total air flow (W36). This range of P2 ensures both ignition of the fuel/air from the high power fuel/air injectors by flame propagation, while producing minimal fume an $NO_x$ emissions at full power.

The values for the permeability P1 allow the turbojet engine to meet the following criteria:

1. Staying within the low pressure turbine overheating limit at startup which requires an injector richness of less than 3.2;
2. It assures an minimum fuel flow C of 4 kg/h per injector, since, below that limit, the fuel/air mixture emanating from the injectors becomes very heterogenous;
3. It assures sufficient air flow to preclude coking of the injectors and interfering with the injection system atomization;
4. It assures a mixture richness (more than 20%) at the limit of lean extinction; and,
5. It assures an injector richness of between 0.9 and 1.3 to optimize emission pollution at low power and to achieve good combustion efficiency.

DETAILED DESCRIPTION OF THE PREFERRED EMBODIMENT

Figure 1:
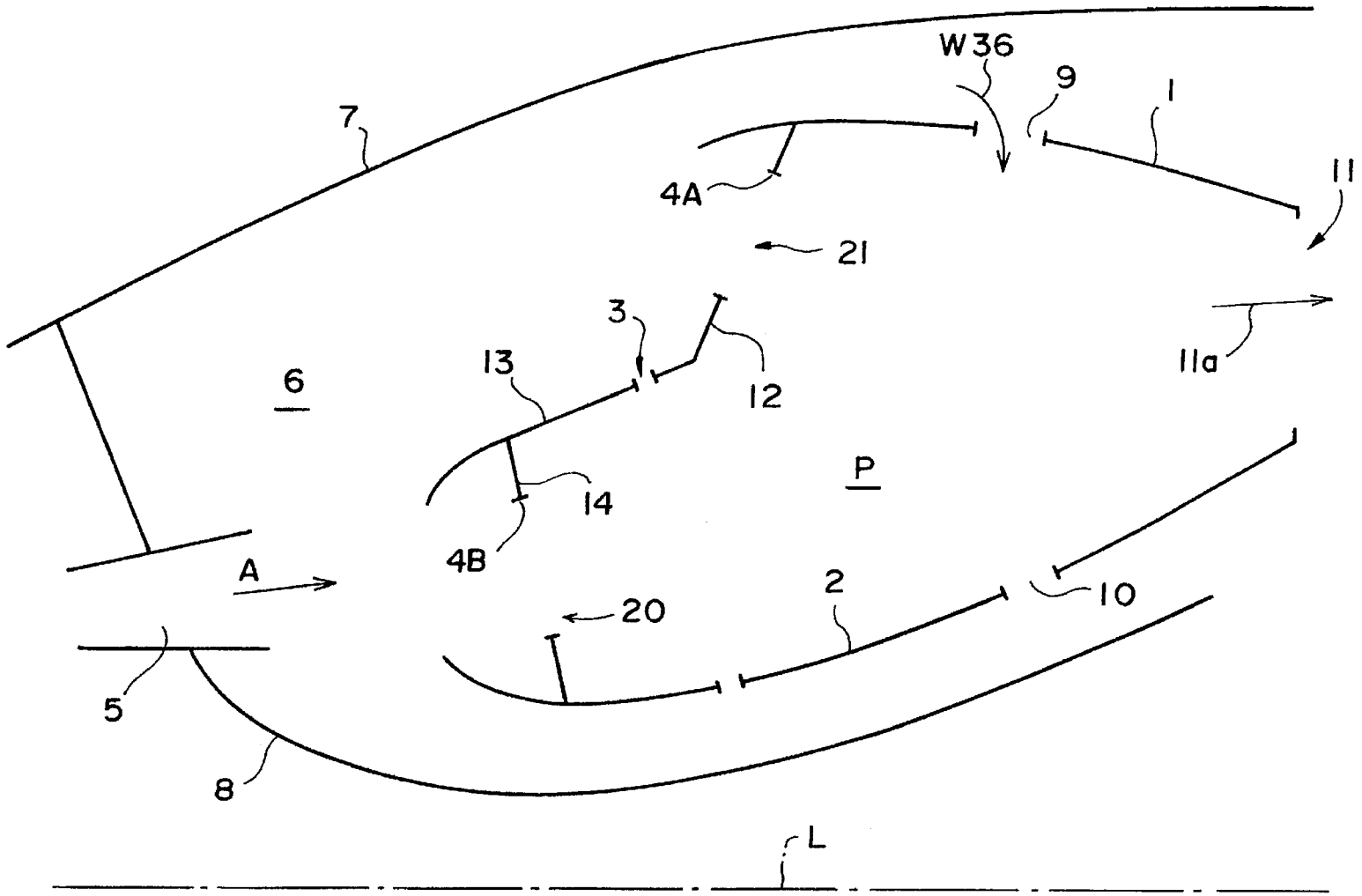
FIG. 1 is a partial, schematic cross-sectional view of a dual-head combustion chamber according to the present invention.

As best illustrated in FIG. 1, the dual head combustion chamber according to the present invention is bounded by an outer annular wall 1, an inner annular wall 2 and an end wall 3 which joins the upstream ends of outer and inner walls 1 and 2. The combustion chamber end 3 comprises a plurality of openings 4 with a fuel/air injection assembly (not shown) mounted in each opening. The combustion chamber is generally annular in configuration and extends about central axis L. A diffuser 5 directs air from the outlet of a high pressure compressor (not shown) so as to feed airflow A into the annular space 6 bounded by an outer casing 7 and an inner casing 8. As can be seen, the combustion chamber is located within the annular space bounded by the outer and inner casings 7 and 8. A portion W36 of the airflow A enters the primary zone P of the combustion chamber through the primary air inlet orifices 9 and 10 formed in the outer wall 1 and the inner wall 2, respectively. The burned gases issue from the combustion through the outlet 11, arrow 11*a* denoting the overall direction of the gas flow inside the combustion chamber.

The end wall 3 has three distinct portions: an outer portion 12 defining a plurality of openings 4A; an annular middle portion 13 extending substantially parallel to the inner wall 2; and an inner portion 14 defining a plurality of openings 4B. Inner portion 14 is located generally downstream of and aligned with the diffuser 5. Fuel/air injector assemblies are located in the openings 4B of the inner portion 14 and constitute the low power head 20, while the fuel/air injector assemblies mounted in openings 4A of the outer portion 12 constitute the high power head 21.

Figure 2:
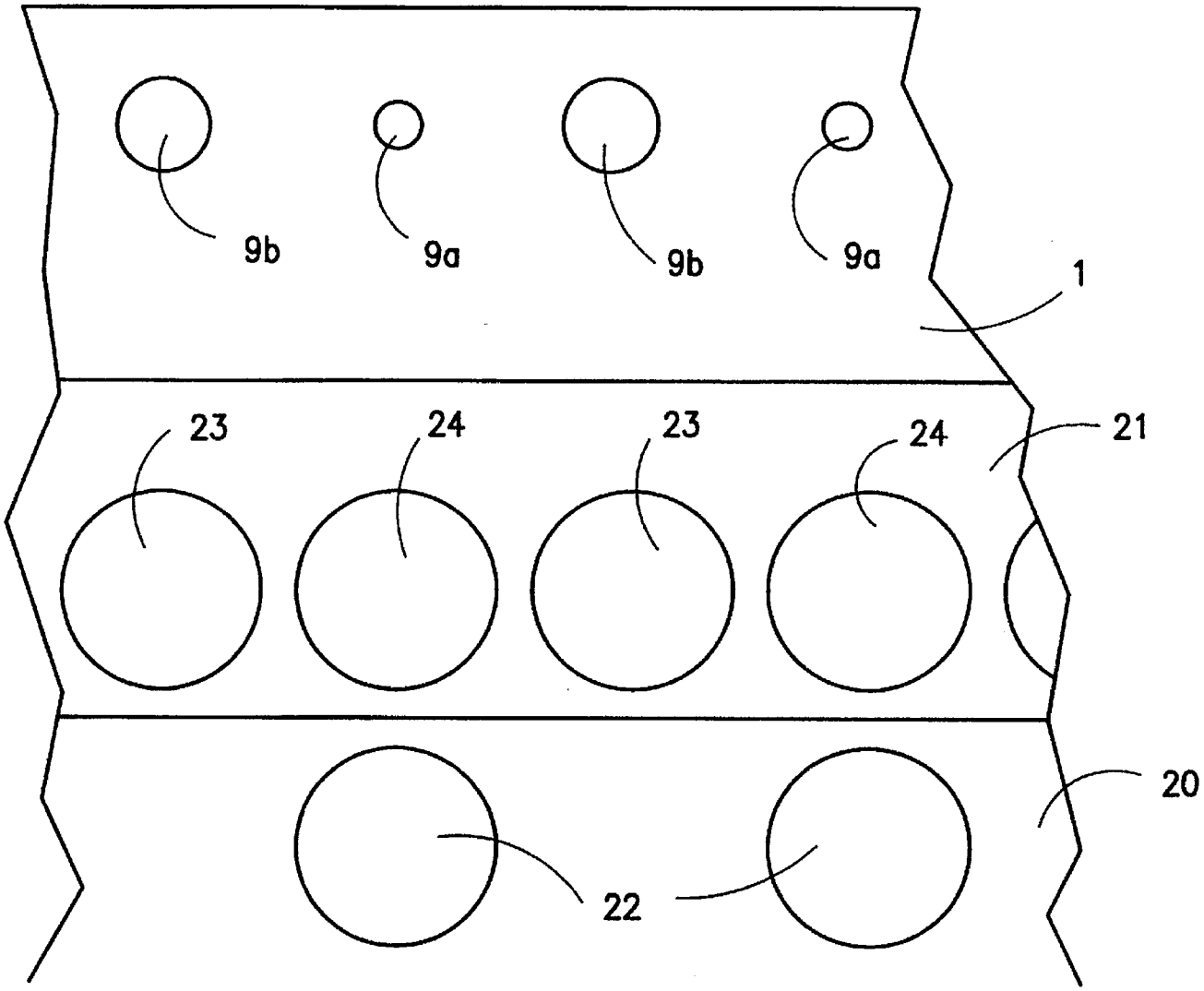
FIG. 2 is an end view of the combustion chamber and wall viewed from the chamber outlet.

The low power head 20 comprises N fuel/air injectors 22 (see FIG. 2) having an air permeability of P1. The high power head 21 has N fuel/air injectors 23, also with an air permeability of P1 and N fuel/air injectors 24 with an air permeability of P2. The fuel/air injectors 24 are aligned with each of the fuel/air injectors 22 of the low power head 20 along a line extending radially from the central axis L. The fuel/air injectors 23, having air permeability of P1, are circumferentially located between adjacent fuel/air injectors 24, as best seen in FIG. 2. The fuel/air injectors 22 and 23 with permeability P1 operate during low power operations of the engine, while the fuel/air injectors 24 with permeability P2 operate during high power operating conditions.

The combustion chamber is ignited and stabilized while the aircraft is on the ground using the fuel/air mixture from the injection systems having P1 permeability (fuel/air injector assemblies 22 and 23). The radially and circumferentially staggered arrangement of the fuel/air injectors 22 and 23 permits the use of a conventional ignition system even if the low power head 20 is located radially inward (toward the central axis of the combustion chamber) relative to the high power head 21. The permeability P2, the air flow through the injectors 24, is higher than the permeability P1 of the fuel/air injectors 22 and 23. The fuel/air injection systems with the permeability P2 are ignited by flame propagation when the high pressure compressor rotational speed reaches approximately 70% of the rated speed of the compressor and operation is continued through full power.

The primary air inlet orifices 9 through the outer wall 1 are located in a line extending radially from the central axis L and through the fuel/air injector assemblies 23 and 24 of the high power head 21. As schematically illustrated in FIG. 2. The primary air inlet orifices 9 comprise orifices 9*a* having an area A1 circumferentially aligned with the fuel/air injectors 24 having a permeability of P2 and orifices 9*b*, each having area A2 such that A2 is greater than A1, which are aligned with the fuel/air injector assemblies 23 having permeability P1. This positioning insures that the local richness in the primary zone P downstream of the orifices 9*a* and 9*b* is identical and homogenous.

Figure 3:
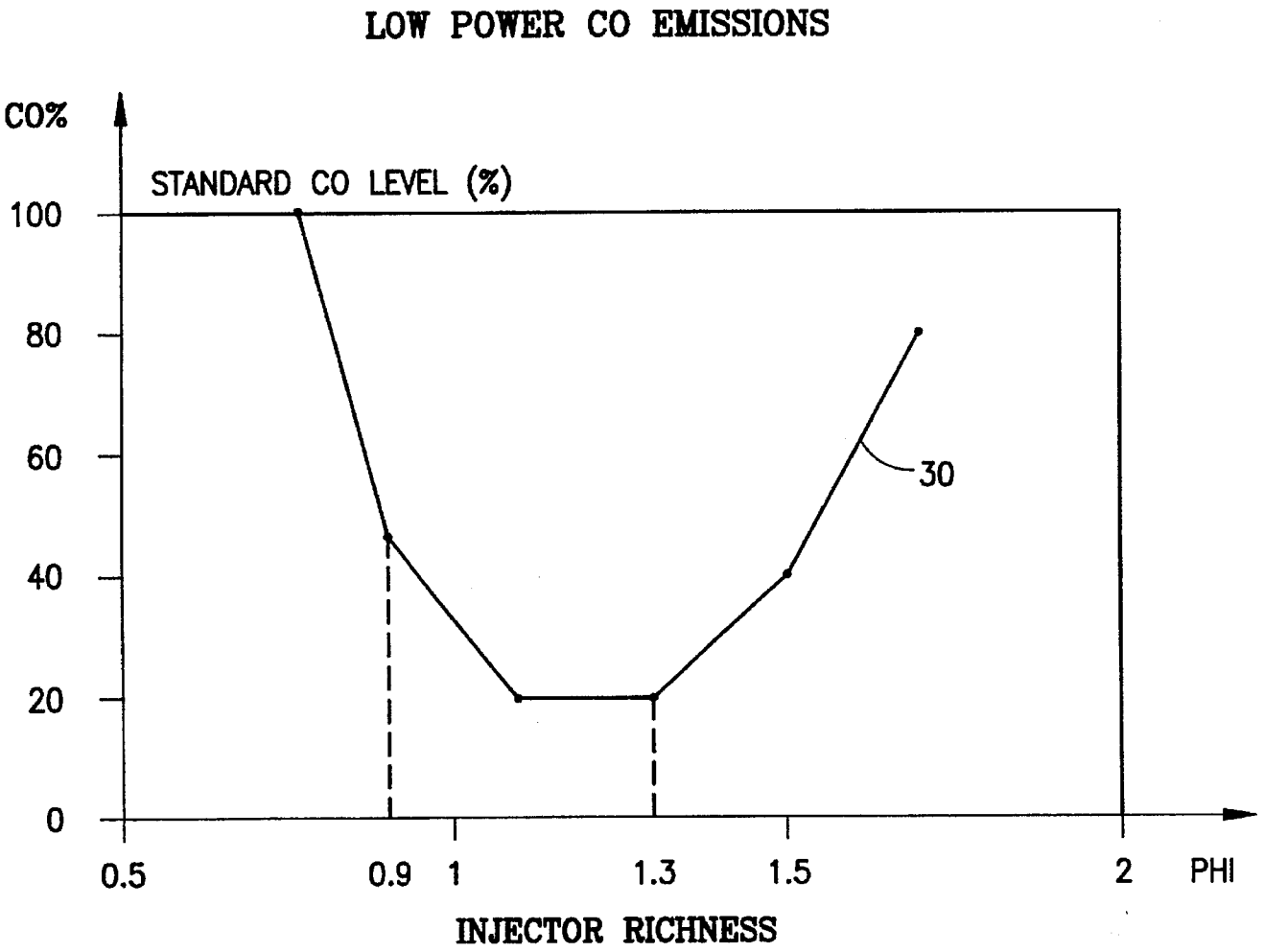
FIG. 3 is a graph of carbonmonoxide emissions as a function of injector richness for the present invention.

FIG. 3 illustrates a curve 30 for CO emissions in the low power mode as a function of injector richness. As can be seen, the injector richness PHI must be between 0.9 and 1.3 to minimize CO emissions.

The fuel/air injection systems 22 and 23 with the permeability P1 must be designed to meet the following criteria:

1. Not to exceed the low pressure turbine overheating limit at startup, which thereby requires the injector richness PHI be less than 3.2;
2. Assure a minimum fuel flow C per injector of at least 4 kg/h, since, for lesser values of C, the fuel/air mixture becomes highly heterogeneous;
3. Assure sufficient air flow to preclude coking of the injectors which would interfere with the atomization of the fuel by the injection system;
4. Assume a mixture richness at the lean-extinction limit; and,
5. Assure an injector richness PHI of between 0.9 and 1.3 to minimize pollution at low power and to achieve good combustions efficiency.

Figure 4:
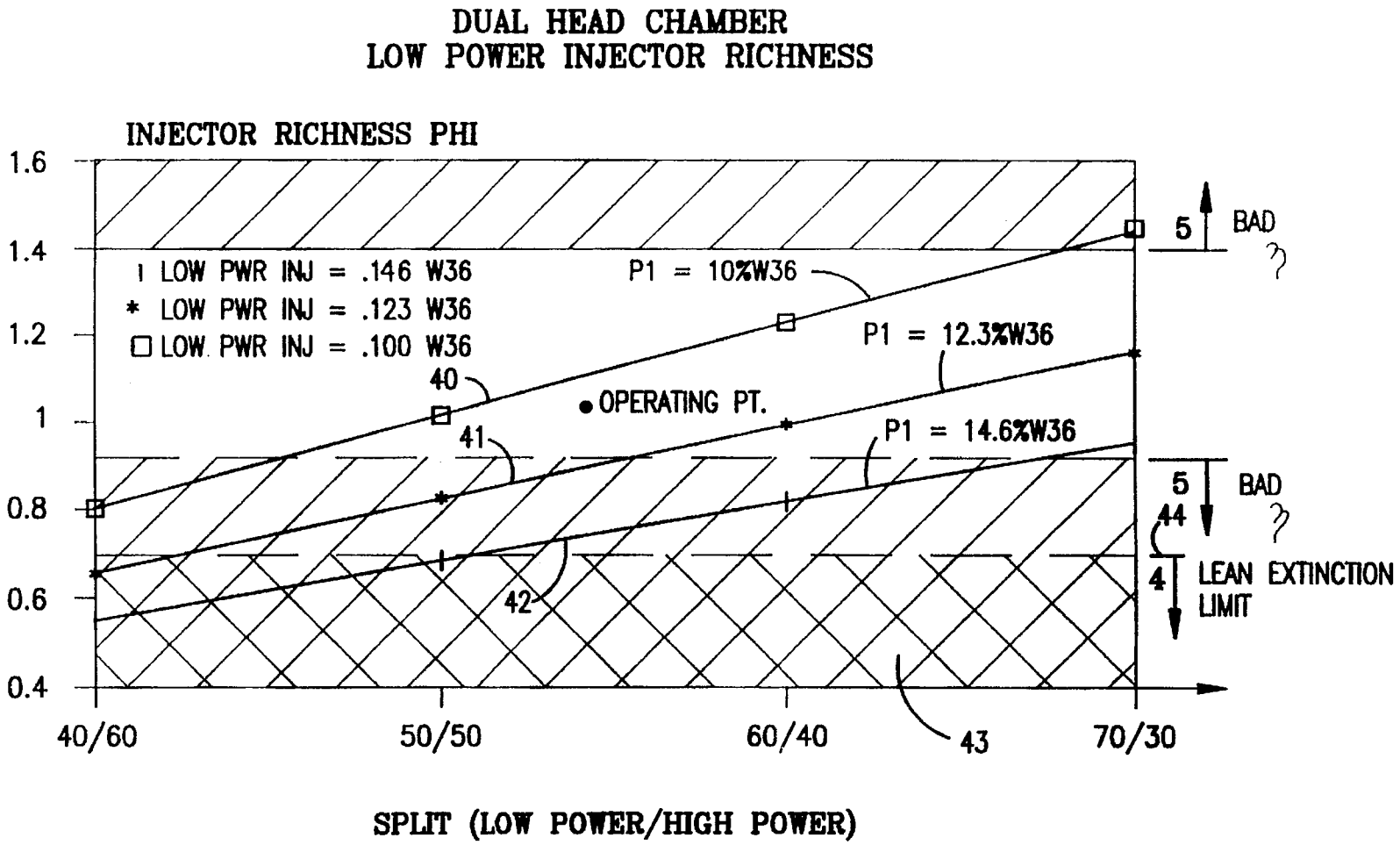
FIG. 4 is a graph of injector richness versus the split between the low power head and the high power head for various values of permeability P1.

In FIG. 4, curves 40, 41 and 42 denote the operational curves of the injection systems with permeability P1 in the low power mode as a function of the injection richness PHI and of the load distribution between the low power head and the high power head. The curve 40 denotes a permeability P1 of 10% of the total air flow (W36) entering the combustion chamber, the curve 41 corresponds to a permeability P1 of 12.3% of W36 and curve 42 corresponds to a permeability P1 of 14.6% of W36. The area 43 located below horizontal line 44 corresponds to flame extinction because of insufficient richness in the primary combustion zone (less than 20%). With the split between the low and the high power head is near 50/50, FIG. 4 illustrates that the permeability P1 of the low power injection system must exceed 12% of W36 in order to meet the above-defined criteria 4 and 5.

Figure 5:
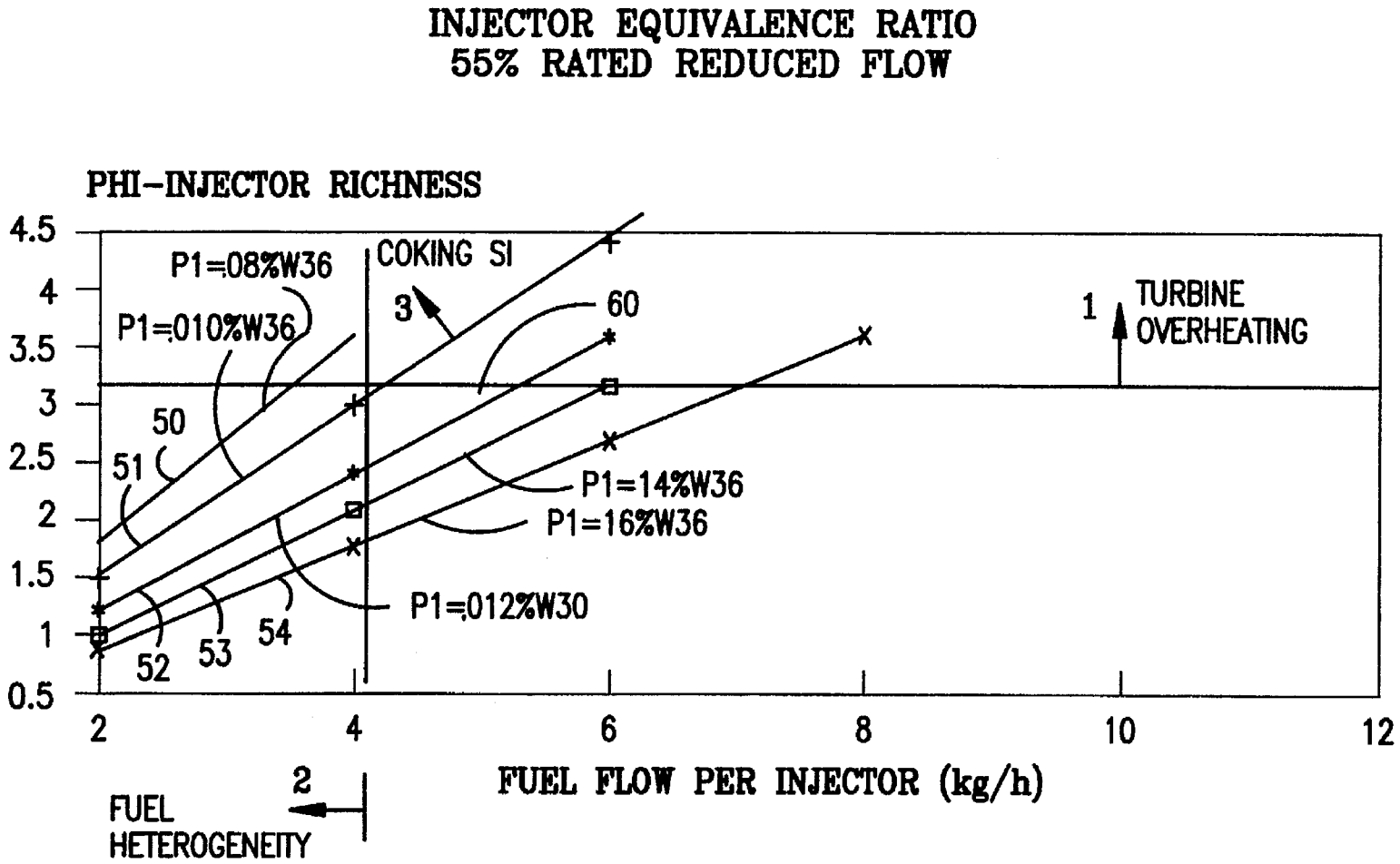
FIG. 5 is a graph of injector richness versus fuel flow per injector for an injector equivalence ratio of 55% of the rated reduced flow for various values of permeability P1.
Figure 6:
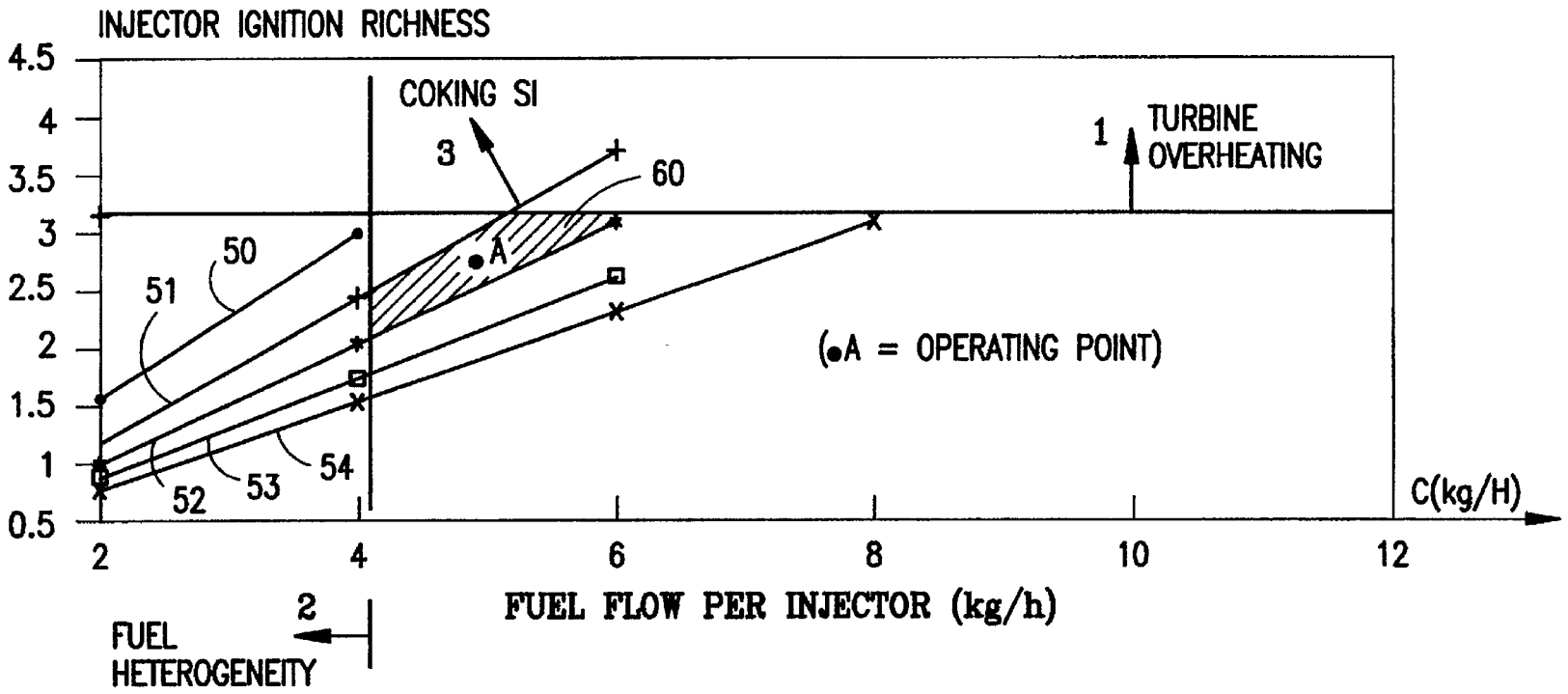
FIG. 6 is a graph similar to FIG. 5 for an injector equivalence ratio of 65% rated reduced flow.

FIGS. 5 and 6 illustrate operating curves of the injection systems having permeability P1 at startup as a function of the injector richness PHI and of the fuel flow per injector. The curve 50 corresponds to a permeability P1 of 8% of W36, while the curves 51, 52, 53 and 54, respectively correspond to permeabilities P1 of 10%, 12%, 14% and 16% of W36. To preclude coloring the fuel injectors, it can be seen that the permeability P1 must be higher than 10% of W36.

FIG. 5 illustrates a combustion chamber of a gas turbine engine of which the starter insures ventilation higher than 55% of the reduced rate combustion chamber flow, while FIG. 6 relates to a gas turbine engine combustion chamber of which the starter assures ventilation higher than 65% of the combustion chamber reduced nominal flow. The shaded are 60 FIG. 6 shows the position of the startup operating points which permit an acceptable tradeoff between the above-defined five criteria. The permeability P1 must be between 10%–12% of W36 and preferably between 11% and 12% of W36.

The fuel injection systems 24 having permeability P2 must be sized in such a manner that they insure ignition by flame impropogation and they must also have minimal emissions of fumes and $NO_x$ at full power. Preferably, the permeability P2 is between 26% and 35% of W36. The dual-head combustion chamber configuration according to the present invention achieves and improved radial temperature distribution throughout the range of performance from low power operation to full power operation, and allows the use of a conventional ignition system even if the low power head 20 is located radially inwardly of the high power head 21.

The foregoing description is provided for illustrative purposes only and should not be construed as in any way limiting this invention, the scope of which is defined solely by the appended claims.

We claim:

1. A generally annular combustion chamber extending around a central axis and comprising:

a) a low power head having N number of fuel/air injector assemblies arranged in a generally annular array and spaced apart in a circumferential direction, the fuel/air injector assemblies having an air permeability of P1 and supplying a fuel/air mixture to the combustion chamber during low power operation wherein the air permeability P1 ranges from 10% to 12% of the total air flow entering the combustion chamber; and, b) a high power head having N number of first fuel/air injector assemblies and N number of second fuel/air injector assemblies, the first and second fuel/air injector assemblies arranged in a generally annular array radially spaced from the low power head, each of the N number of second fuel/air injector assemblies aligned with a fuel/air injector assembly of the low power head along a line extending radially from the central axis, the second fuel/air injector assemblies having an air permeability of P2 such that P2>P1 and supplying a fuel/air mixture to the combustion chamber during high power operation, the first fuel/air injection assemblies each located circumferentially between adjacent second fuel/air injector assemblies and having an air permeability of P1, the first fuel/air injector assemblies supplying fuel/air mixture to the combustion chamber during low power operation.

2. The combustion chamber of claim 1 wherein the air permeability P2 ranges from 26% to 35% of the total air flow entering the combustion chamber.

3. The combustion chamber of claim 1 further comprising:

a) a plurality of first primary air inlet orifices each having an area A1 and aligned with a second fuel/air injector assembly in a circumferential direction around the central axis; and, b) a plurality of second primary air inlet orifices, each having an area A2 such that A2>A1 and aligned with a first fuel/air injector assembly in a circumferential direction around the central axis.

4. The combustion chamber of claim 3 further comprising an outer wall forming a radially outer boundary of the combustion chamber and having therein the first and second primary air inlet orifices.

5. A generally annular combustion chamber extending around a central axis and comprising:

a) a low power head having N number of fuel/air injector assemblies arranged in a generally annular array and spaced apart in a circumferential direction, the fuel/air injector assemblies having an air permeability of P1 and supplying a fuel/air mixture to the combustion chamber during low power operation;

b) a high power head having N number of first fuel/air injector assemblies and N number of second fuel/air injector assemblies, the first and second fuel/air injector assemblies arranged in a generally annular array radially spaced from the low power head, each of the N number of second fuel/air injector assemblies aligned with a fuel/air injector assembly of the low power head along a line extending radially from the central axis, the second fuel/air injector assemblies having an air permeability of P2 such that P2>P1 and supplying a fuel/air mixture to the combustion chamber during high power operation, the first fuel/air injection assemblies each located circumferentially between adjacent second fuel/air injector assemblies and having an air permeability of P1, the first fuel/air injector assemblies supplying fuel/air mixture to the combustion chamber during low power operation;

c) a plurality of first primary air inlet orifices each having an area A1 and aligned with a second fuel/air injector assembly in a circumferential direction around the central axis; and, d) a plurality of second primary air inlet orifices, each having an area A2 such that A2>A1 and aligned with a first fuel/air injector assembly in a circumferential direction around the central axis.

6. The combustion chamber of claim 5 wherein the air permeability P2 ranges from 26% to 35% of the total air flow entering the combustion chamber.

7. The combustion chamber of claim 5 further comprising an outer wall forming a radially outer boundary of the combustion chamber and having therein the first and second primary air inlet orifices.

* * * * *